US006138862A

United States Patent [19]

Tai

[11] Patent Number: 6,138,862

[45] Date of Patent: Oct. 31, 2000

[54] CUP STRUCTURE WITH HEAT ISOLATION EFFECT

[76] Inventor: Daniel Tai, 4519 Hatch La., Lisle, Ill. 60532-4360

[21] Appl. No.: 09/273,354

[22] Filed: Mar. 22, 1999

[51] Int. Cl.[7] ..... B65D 23/02

[52] U.S. Cl. ..... 220/592.17; 220/739; 206/520; 206/516

[58] Field of Search ..... 220/739, 592.09, 220/592.17, 592.16, 592.23; 206/520, 519, 516

[56] References Cited

U.S. PATENT DOCUMENTS

| | | | |
|---|---|---|---|
| 1,272,762 | 7/1918 | Baughman | 220/592.23 |
| 2,863,585 | 12/1958 | Meshberg | 220/592.17 |
| 3,138,280 | 6/1964 | Shafer | 220/739 |
| 3,257,025 | 6/1966 | Jolly | 220/739 |
| 3,971,360 | 7/1976 | Spoeth, Jr. | 220/592.23 |
| 4,534,391 | 8/1985 | Ventimiglia et al. | 220/739 |
| 4,540,611 | 9/1985 | Henderson | 220/739 |
| 4,735,333 | 4/1988 | Lay et al. | 220/739 |
| 5,573,141 | 11/1996 | Chen | 220/739 |

*Primary Examiner*—Joseph M. Moy
*Attorney, Agent, or Firm*—Rosenberg, Klein & Lee

[57] ABSTRACT

A cup structure with heat isolation effect is disclosed, thereby, if two cups according to the present invention are overlapped, the combined cups have a preferred heat isolation effect. The bottom of the cups are installed with respective isolation elements. When th user overlaps two cups, he (or she) can rotate the inner cup with an angle, so that the isolation element of the inner cup can rest against the isolation element of the outer cup. Therefore, by the shielding the isolation element of the outer cup, the bottom of the inner cup can not rest against the bottom of the outer cup, thus a space is formed therebetween. Especially, the handle on the lateral side of the cup has a preferred effect. Therefore, it a hot food is filled into the cup, because of the isolation of the space, the hot temperature of the inner cup can not be transferred to the outer cup and thus the good heat isolation effect is attained.

6 Claims, 3 Drawing Sheets

CUP STRUCTURE WITH HEAT ISOLATION EFFECT

BACKGROUND OF THE INVENTION

1. Field of the Invention

The present relates to a cup structure with heat isolation effect. Wherein cups according to the present invention are overlapped with a space therebetween, the combined cups have a preferred heat isolation effect. When a plurality of cups are desired to be overlapped for transformation and storage, since the isolation element of the inner cup will tightly rest against the isolation element of the outer cup, thus no space is formed therebetween. The space is saved and thus the cost for transferring and storage is reduced greatly.

2. Background of the Invention

Since the improvement of technology, the life of human has been changed greatly. Human often needs to eat fast foods. However, this induce the demand of a great number of discardable cups, such as paper cups, plastic cups, etc. But since the heat isolation of paper and plastic material are poor, thus people often needs to further enclose a sheet of toilet paper around the cup for isolating heat, or two cups are overlapped. Because the two cups or the toilet paper and the cup are overlapped closely, thus the heat still transfers outwards. The original heat isolation effect is reduced. If the beverage or soup within the cup is too hot, this method will fail completely.

SUMMARY OF THE INVENTION

Accordingly, the object of the present invention is to provide a cup structure with heat isolation effect. Thereby, if two cups according to the present invention are overlapped, the combined cups have a preferred heat isolation effect. The bottom of the cups are installed with respective isolation elements. When the user overlaps two cups, he (or she) can rotate the inner cup with an angle, so that the isolation element of the inner cup can rest against the isolation element of the outer cup. Therefore, by the shielding the isolation element of the outer cup, the bottom of the inner cup can not rest against the bottom of the outer cup, this a space is formed therebetween. Especially, the handle on the lateral side of the cup is a preferred effect. Therefore, if a hot food is filled into the cup, because of isolation of the space, the hot temperature of the inner cup can not be transferred to the outer cup and thus good heat isolation effect is attained.

Another object of the present invention is to provide a cup structure with heat isolation effect, wherein each isolation element of the cups includes a first protrusion, while two sides of the first protrusion are installed with respective second protrusions. Each second protrusion is smaller than the first protrusion, and has a height lower than the first protrusion. The first and the second protrusions have rectangular or triangular or other polygonal shapes.

A further object of the present invention is to provide a cup structure with heat isolation effect, wherein when a plurality of cups are desired to be overlapped for transformation and storage, since the isolation element of the inner cup will tightly rest against the isolation element of the outer cup, thus no any space is formed therebetween. The space is saved and thus the cost for transferring and storage is reduced greatly.

The present invention will be better understood and its numerous objects and advantages will become apparent to those skilled in the art by referencing to the following drawings in which:

DETAILED DESCRIPTION OF THE PREFERRED EMBODIMENT

Figure 1:
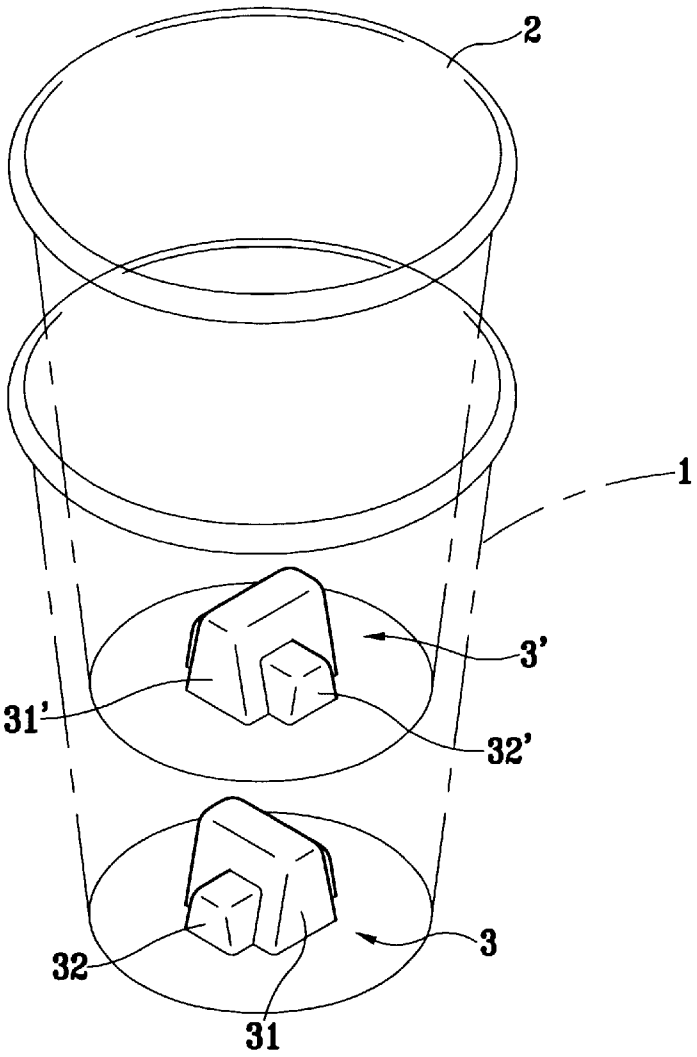
FIG. 1 is a perspective view of the present invention.

With reference to FIG. 1, the cup structure with heat isolation effect of the present invention is illustrate. In the present invention, when two discardable cups 1 and 2 are overlapped, they have preferred heat isolation effect. In this embodiment, the cup is a paper cup. The bottom of the two cups 1 and 2 are projected with respective isolation elements 3 and 3'. The isolation elements 3 and 3' include rectangular first protrusions 31 and 31'. While two sides of the first protrusions 31 and 31' are installed with respective second protrusions 32 and 32' which also have a rectangular shape. Each second protrusion 32 is smaller than the first protrusion 31 and the height thereof is also lower than the first protrusion 31. Of course, the first protrusion and the second protrusion can have other shapes, such as triangular shape or polygonal shapes, etc.

Figure 2:
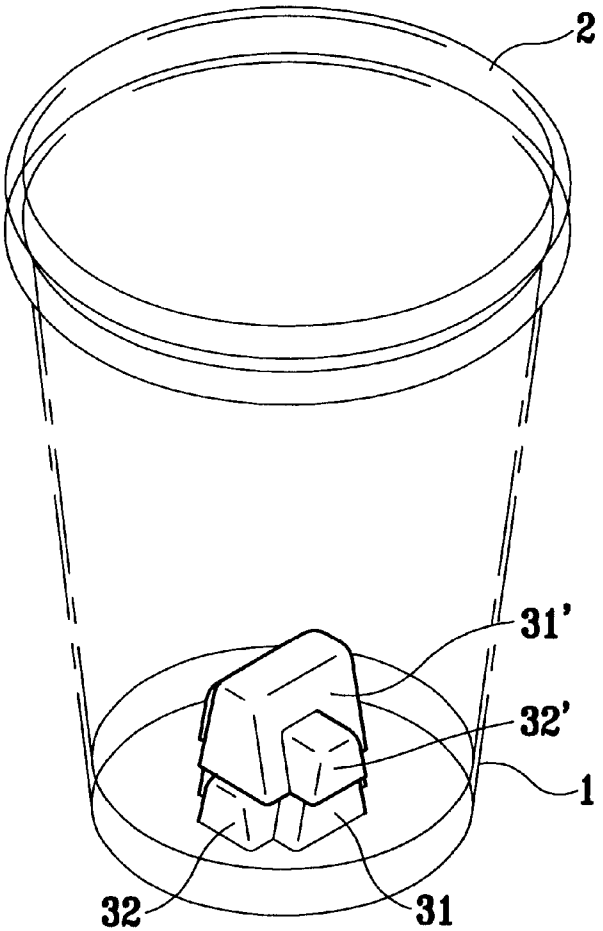
FIG. 2 is a perspective view showing that two cups of the present invention are overlapped.
Figure 3:
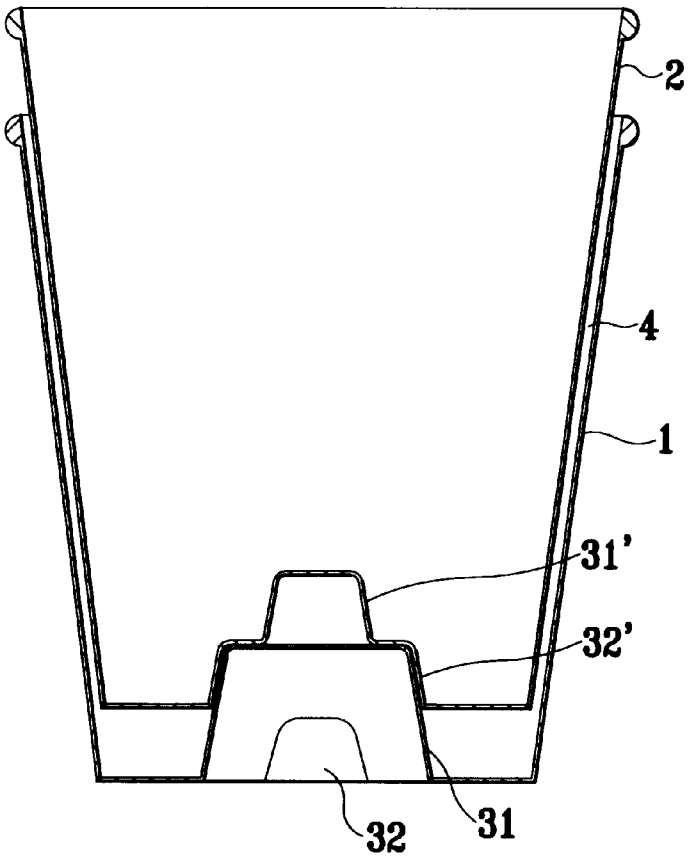
FIG. 3 is a cross sectional view showing two cups overlapped.

Referring to FIGS. 2 and 3, if the two cups 1 and 2 are desired to be overlapped, the inner cup 2 is necessary to rotate so that the isolation element 3' installed in the bottom of the inner cup 2 are interleaved with the isolation element 3 within the cup 1. Assume the isolation element 3' within the bottom of cup 2 resists against the upper portion of the isolation element 3 within the outer cup 1. In this embodiment, the two cups are rotated with one another by an angle of 90 degrees so that the first protrusion within the outer cup 1 will tightly rest against the second protrusion on the bottom of the inner cup 2. Therefore, by shielding of the isolation element 3 of the outer cup 1, the bottom of the inner cup 2 will not completely rest against to the bottom of the outer cup 1. As a result, a space 4 is formed between the two cups 1 and 2, and especially on the handle on the lateral side of the cup.

In the present invention, if the beverage is cool, only one cup is sufficient. But if the beverage is hot, such as hot coffee or soup, since the space 4 is formed between the two cups 1 and 2. By isolating the space 4, the high temperature in the inner cup 2 can not be transferred to the outer cup 1. Thus, if the user holds the outer cup 1, the user's hand will not be hurt. Accordingly, a preferred heat isolation effect is achieved. Moreover, if a plurality of cups are necessarily overlapped for transformation or storage, the isolation element 3' on the inner cup 2 will tightly rest against the upper portion of the isolation element 3 of the outer cup 1 so that there is no space between the inner cup and the outer cup, and thus the cost for transformation and storage are saved greatly.

Although the invention has been described in detail with reference only to a preferred embodiment, those skilled in the art will appreciate that various modifications can be made without departing from the invention. Accordingly, the invention is defined only by the following claims which are intended to embrace all equivalent thereof.

DESCRIPTION OF THE NUMERALS IN FIGURES

1, 2 cup

3, 3' isolation element

31, 31' first protrusion

32, 32' second protrusion

4 space

What is claimed is:

1. A cup system for providing a thermal isolating structure comprising a pair of cups, each of said cups having:

a. an open cavity defined by a continuous side wall and a bottom wall formed at one end thereof;

b. a first protrusion formed in said bottom and extending a first predetermined distance into said open cavity; and, c. a pair of second protrusions formed in said bottom wall on opposing sides of said first protrusion and extending into said open cavity a second predetermined distance, said second predetermined distance being less than said first predetermined distance, wherein (1) said pair of cups are nestable when a first of said pair of cups is inserted into said open cavity of a second of said pair of cups with said first and second protrusions of said first cup respectively aligned with said first and second protrusions of said second cup, and (2) said first cup is supported within said open cavity of said second cup on a top surface of said first protrusion of said second cup when said second protrusions of each of said cups are respectively non-aligned and thereby space said side wall of said first cup from said side wall of said second cup to provide thermal isolation therebetween.

2. The cup system as recited in claim 1 where each of said pair of cups are formed from a material selected from the group consisting of paper and plastic.

3. The cup system as recited in claim 1 where said first and second protrusions of each of said pair of cups has a polygonal contour.

4. A cup system for providing a thermal isolating structure comprising a pair of cups, each of said cups having:

a. an open cavity defined by a continuous side wall and a bottom wall formed at one end thereof; and, b. an isolation element formed in said bottom and extending into said open cavity, said isolation element having a non-symmetrical contour about a vertical axis thereof, wherein (1) said pair of cups are nestable when a first of said pair of cups is inserted into said open cavity of a second of said pair of cups with said isolation element of said first cup respectively aligned with said isolation element of said second cup, and (2) said first cup is supported within said open cavity of said second cup on an uppermost surface of said isolation element of said second cup when said isolation element of said first cup is angularly offset by approximately 90 degrees with respect to said isolation element of said second cup, thereby spacing said side wall of said first cup from said side wall of said second cup to provide thermal isolation therebetween.

5. The cup system as recited in claim 4 where each said isolation element is formed by a first protrusion extending into said open cavity of a respective cup and a pair of second protrusions formed on opposing sides of said first protrusion and extending into said open cavity.

6. The cup system as recited in claim 5 where said first protrusion extends into said open cavity a greater distance than each of said pair of second protrusions.

* * * * *